United States Patent [19]

Kirjanov et al.

[11] Patent Number: 4,857,392

[45] Date of Patent: Aug. 15, 1989

[54] STAINBLOCKER AND FLUOROCARBON OIL REPELLENTS

[75] Inventors: Alexander S. Kirjanov, Reading, Pa.; Dieter Hoecklin, Charlotte, N.C.

[73] Assignee: Crompton & Knowles Corporation, Stamford, Conn.

[21] Appl. No.: 207,150

[22] Filed: Jun. 15, 1988

[51] Int. Cl.[4] ..... B05D 1/18; B32B 27/08; B32B 27/34; B32B 27/42

[52] U.S. Cl. ..... 428/267; 427/430.1; 428/475.5; 428/477.4; 524/539; 524/541; 525/442; 525/488

[58] Field of Search ..... 427/393.4, 389.9, 430.1; 428/267, 421, 822, 475.8, 476.3, 477.4; 524/539, 541, 442; 525/488

[56] References Cited

U.S. PATENT DOCUMENTS

| | | | |
|---|---|---|---|
| 3,904,575 | 9/1975 | Satokawa et al. | 524/363 X |
| 4,031,288 | 6/1977 | Bhakuni et al. | 428/277.4 X |
| 4,595,628 | 6/1986 | Kelly et al. | 428/267 X |

*Primary Examiner*—Michael Lusicnan

*Attorney, Agent, or Firm*—Bernard Francis Crowe

[57] ABSTRACT

This invention relates to a new composition and process that affords "total stain protection" finishing of polyamide products, i.e., carpet. This composition of non-ionic fluorocarbon and sulfomethylated phenolformaldehyde condensates provides protection against oil and water-borne soils and in addition, protects the treated substrate against food colors by means of a one-step application.

18 Claims, No Drawings

STAINBLOCKER AND FLUOROCARBON OIL REPELLENTS

BACKGROUND OF THE INVENTION

It has been a standard practice for many years to apply to carpets and upholstery, mainly those made of nylon and other natural and synthetic polyamides, fluorocarbon finishes. The purpose of such finishes is to protect the said substrates, frequently used and expensive to clean, from oil and water-borne soils.

Fluorocarbon finishes, among which there are brands such as Scotchgard (by 3M Company), Zepel, and Teflon (the latter two are by E. I. du Pont de Nemours & Co.), offer oil and water repellency to substrates finished with them, and thus also protect against soils, both oily or aqueous in nature.

Although fluorocarbon finishes do perform their intended functions, they have one important drawback. When a droplet of oil is deposited on the surface of a fluorocarbon-treated substrate (or a droplet of water), it does not soak into the substrate, but stays on the surface forming a bead. If however, this bead is pressed, with a hand (or a shoe, in the case of carpets), the oil or water bead will penetrate the fabric.

The above described phenomenon is not of great concern when the liquid medium is not a soil carrier, i.e. clean medium; but if the medium is contaminated, the substrate will soil.

Such soiling, especially if its sources are oily foods or aqueous drinks, colored with artificial colorants, will, especially on polyamide substrates (i.e. nylon, wool), leave a visible spot, often indelible. The reason for this is that said colorants are anionic dyes of the same class used to dye nylon and wool. In addition, many foods, and especially drinks, contain acids which accelerate the dyeing process of polyamides; that is, such dyeing can proceed at room temperature in the presence of citric, tartaric, and other acids used in the preparation of edible and potable products.

Moreover, practically all fluorocarbon finishes, such as Scotchgard FC-352, FC-358, FC-393, specifically intended for carpets (called "carpet protectors" by the manufacturer) are fluorocarbon emulsions prepared with a cationic emulsifying system. This aggravates the problem, described in the previous paragraph, as follows:

Since the food colors, described above, are anionic in nature, they will be attracted to substrates finished with the said fluorocarbons, unless the cationic emulsifier is completely removed from the carpet by rinsing after finishing. This is not easy because, at this point, the finished substrate is water repellent and the rinsing medium can not penetrate the substrate to remove said cationic emulsifier. This problem can be overcome, as will be seen further below.

Because of the above described drawback, coupled with frequent incidents involving spilled foods and soft drinks containing food colors, the carpet fiber manufacturers developed new carpet protection systems, such as Stainmaster TM (E. I. du Pont de Nemours & Co.). This and other systems involve the application of a stainblocker (acid dye reserving agent) usually before applying the fluorocarbon finish. In some cases the fluorocarbon finish is built into the fiber before the substrate (i.e. carpet) is made. In such cases, the stainblocker application follows in the dyeing establishment.

Such stainblockers have been described in U.S. Pat. Nos. 4,501,591; 4,592,940; and 4,680,212.

This sequential application of stainblocker and fluorocarbon finishes came to be known as "total stain protection" in the consumer market.

At this time the carpet mills are willing to accept the extra step required to accomplish this "total stain protection" because of the good consumer reception of this new development. However, if it were possible to apply the said fluorocarbon finish together with the stain blocker, that is in a one-bath-one step fashion, the mills would realize considerable labor and time savings. Moreover, since all finishes affect the cast of a dyed shade, which must be compensated for when developing a dyeing formula, a one-step procedure would simplify this compensation, i.e. a single compensation is quicker to accomplish than a double one. Even in the case of fibers with built-in fluorocarbon finish, the mills are often forced to fortify their effect with a topical application of more fluorocarbon in the mill, so that in practical terms, "the total stain protection" is almost always a two-step process.

There is another important area where a one-step process would be desirable. There arises a need to apply fluorocarbon and stain blocking finishes on carpets already installed in private homes or institutional buildings, such as hotels, offices, hospitals, etc. to, boost the effect of mill-applied finishes following professional cleaning operations (which decrease the "total stain protection" effect after a number of such cleanings). Such "on-site" applications are also carried out on older carpets which lack such "total stain protection."

At this time such on-site finishing must also be carried out in two steps, as in the mills, with the ensuing aggravation to the private home owners and the institutional patrons because the premises can not be used while the carpet is treated, and while it dries. Hence a one-step process would be very desirable in this case as well.

It is known, that stainblocking agents are all strongly anionic compositions (see the above mentioned patents) and the fluorocarbons, mentioned above, are emulsions containing cationic emulsifiers, thus, when combined in a single bath they precipitate due to mutual neutralization of the cationic and anionic charges of the respective finishes. There are, however, a few fluorocarbon finishes that are nonionic in nature, such as Scotchgard FC-357. However, products such as he latter are emulsions, or dispersions, (some companies describe them as emulsions, others as dispersions) and are very sensitive to anionically charged compounds, such as stain blockers. These said emulsions or dispersions are broken when they are put in contact with the said stainblockers.

There exist very few solution-type nonionic fluorocarbon finishes, such as the Fluorinated Esters Enumerated in U.S. Pat. No. 4, 472,466. These products, although described by the manufacturer as a "fluorochemical emulsion", are actually quasi-solutions at the specific concentrations offered for sale. These products should in theory be compatible with stainblockers, such as those described in U.S Pat. Nos. 4,501,591; 4,592,940; and 4,640,212. Unfortunately, this is not the case. Fluorinated Esters are acid in nature (pH 3.2), whereas the stainblocking finishes have a pH above 7, or as high as 10. When the latter fluorocarbon finish is mixed with stain blocking finishes, such as those of the prior art, a precipitate settles to the bottom of the combined solution. The same phenomenon occurs when attempting to equalize the pH of both products by raising the pH of the acid finish, or by lowering the pH of the alkaline finish, with base or acid, whatever the case may be.

SUMMARY OF THE INVENTION

We have now discovered that all the above impediments to a one bath—one step "total stain protection" finishing of polyamide substrates, i.e. carpets, can be totally eliminated when using a non-ionic fluorocarbon in combination with a stainblocking compound [1], which can be described as follows:

The sulfomethylated derivative used in this invention can be described as follows:

$$[R—CH_2]_n—CH_2SO_3M \quad [1]$$

Where R is a phenolic derivative such as naphthol, alkyl naphthol, thiodiphenol, alkylthiodiphenol, phenol, alkylphenol, 4,4'-dihydroxydiphenyl sulfone, alkyl 4,4'-dihydroxydiphenyl sulfone, 4,2'-dihydroxydiphenyl sulfone, alkyl 4,2'-dihydroxydiphenyl sulfone, bisphenol 'A' or alkylbisphenol "A" and n=1 to 6; and M is H, an alkali metal, $-NH_4$, or an amine (primary, secondary or tertiary).

The fluorocarbon finishes used in this invention are nonionic fluorocarbon solutions, or quasi-solutions, such as Fluorinated Esters depicted by the formula (Compound II):

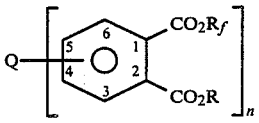

wherein n is 2 or 3

Q has a valence equal to n and is selected from the group consisting of a single carbon-carbon bond-,$—C_mH_{2m}—$, $C_mH_{2m-1}—$,—CO—, —NH —, —O—, —S—,$—SO_2—$, wherein m is 1 to 6, R is selected from $—CH_2CH(R_1)OH$, $—CH_2CH(OH)CH_2X$,$—CH_2CH(OH)CH_2)CH_2CH(OH)CH_2X$, or $—CH_2CH(R_1)OCH_2CH(R_1))H$, wherein $R_1$ is hydrogen or methyl and X is chloro, bromo, hydroxy, or cyano; and $R_f$ is a fluorinated radical of the formula$—W(C_dF_{2d})Y$ wherein W has from 1 to 10 carbon atoms and selected from alkylene and $W'—Z—(W'')_e$ where W' and W'' are alkylene, Z is O, S, NHCO, $NHSO_2$, and e is 0 or 1, Y is hydrogen, fluoro, or perfluoroalkoxy of 1 to 6 carbon atoms, and d is 2 to 20.

Combinations of compounds [1]and [II], in amounts necessary to accomplish the desirable effect of each finish can be dissolved in water and combined in a stable single treatment bath, adjusted to a pH below 6, more commonly 2.5–4 and applied to a polyamide substrate, previously dyed, by any usual continuous process, such as spraying, padding, soaking, etc. followed by air drying, steam drying, or hot air drying. This can be done on such substrates in the mill, or on items made into furniture from said substrate; or on carpets installed in living or work areas.

It should be pointed out that the drying process is immaterial to this invention since it is a matter of the drying means practicable or available. Also the concentrations of [I]an [II] are limited only by the desirable ratio of the properties required for the treated substrate.

EXAMPLES OF THE INVENTION

PROCEDURE FOR TESTING FOOD COLOR STAINBLOCKING EFFECT

The staining solution consisted of a packet of cherry Kool-Aid dissolved in 2 quarts of potable water and 4 tablespoons of granulated sugar. According to the manufacturer, Kool-Aid contains citric Acid, calcium phosphate, artificial color, and vitamin C. The packet contains 3.9 grams of powder.

The artificial color of this soft drink concentrate is FD&C Red 40, an ingredient of many foods. Since FD&C Red 40, as many FD&C Colors, is an acid dye, it stains nylon, and other polyamide fibers. The acidity of the prepared drink (Citric acid) aggravates the staining ability, actually a form of cold dyeing, of polyamide fibers.

A4×4 inch (size is not important) piece of the finished, or unfinished, dry stainblocker substrate (dyed or white; testing was done on white substrate to see the full impact of staining) was saturated in the above solution at 160° F., for 5 minutes, removed, and washed with water.

The resulting red stain remaining after a 1 minute water rinse is rated, once the sample has been dried, using the conventional AATCC rating scale system:

1= very heavy stain

5= no stain

PROCEDURE FOR TESTING THE OIL REPELLENCY OF THE FLUOROCARBON FINISH

The method used was AATCC Test Method 118-1983, an American Standard, as described in the AATCC Technical Manual (1988) pp. 200–201. The oil repellency rating scale is designated by from 1–8, where numbers 5–8 designate a commercially acceptable performance.

EXAMPLE 1

This example illustrates the application of a product commercially used by on-site carpet and upholstery treatment operators. This product is petroleum solvent-based. A cut pile Nylon 6.6 carpet was sprayed with [product]617-88 CR blend, supplied by Chemron International, so as to deposit 100% on the weight of carpet of the mentioned product. The results were as follows:

Kool-Aid Stain Rating: 1

Oil Repellency Rating: 7

EXAMPLE 2

A solution of compound [II]was dissolved in water and sprayed on the material of Example 1. The solution contained 3% of the product. 100% on weight of carpet was deposited. The carpet was dried at 225% F. in an oven. The results were:

Kool-Aid Stain Rating: 1

Oil Repellency Rating: 7–8

EXAMPLE 3

The following aqueous solution was applied to the carpet leaving 100% of said solution on the latter (on the weight of carpet):

Compound [II]: 3%

Compound [I]: 6%

Water: qs dried as in Example 2. The results were:

Kool-Aid Stain Rating: 4–5

Oil Repellency Rating: 7–8

EXAMPLE 4

A solution was prepared as follows:

| | |
|---|---|
| Compound [II]: | 3 parts |
| Compound [I]: | 6 parts |
| Water: | 76 parts |
| Total | 100 parts |

This mixture was stable for at least one month. It was applied to a Nylon 6 carpet at 40% on weight of the latter with the following results:

Kool-Aid Stain Rating: 4–5

Oil Repellency Rating: 4–8

EXAMPLE 5

A solution of Example 4 was prepared using Intratex N (C&K Corp.), a sulfonated phenol-formaldehyde, instead of Compound [I]. The solution coagulated while it was mixed and could not be applied to any polyamide substrate.

We claim:

1. A one bath-one step total stain protection composition comprising an effective amount of a sulfomethylated phenol-formaldehyde condensate and an effective amount of a nonionic aqueous fluorocarbon solution.

2. The composition of claim 1, wherein the sulfomethylated phenol-formaldehyde condensate is:

$$[CH—CH_2]_n—CH_2SO_3M \quad [1]$$

Where R is a phenolic derivative such as naphthol, alkyl naphthol, thiodiphenol, alkylthiodiphenol, phenol, alkylphenol, 4,4'-dihydroxydiphenyl sulfone, alkyl 4,4'-dihydroxydiphenyl sulfone, 4,2'-dihydroxy, bisphenol 'A' or alkylbisphenol "A" and n=1 to 6;

and M is H, an alkali metal,—$NH_4$, or an amine (primary, secondary or tertiary)

3. The composition of claim 1, wherein the nonionic fluorocarbon is a fluorinated ester.

4. The composition of claim 1, wherein the nonionic fluorocarbon is a fluorinated ester of a multi-ring anhydride.

5. The composition of claim 1, wherein the nonionic fluorocarbon is:

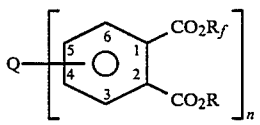

wherein n is 2 or 3 Q has a valence equal to n and is selected from the group consisting of a single carbon-carbon bond, —$C_mH_{2m}$—, $C_mH_{2m-1}$—,—CO—,—NH—,—O—,—S—,—$SO_2$—, wherein m is 1 to 6, R is selected from —$CH_2CH(R_l)OH$, —$CH_2CH(OH)CH_2X$,—$CH_2CH(R_1)OCH_2CH(R_1)OH$, or —$CH_2CH(OH)CH_2$ $_{OCH2}CH(OH)CH_2X$ wherein $R_1$ is hydrogen or methyl and X is chloro, bromo, hydroxy, or cyano; and $R_f$ is a fluorinated radical of the formula —$W(c_dF_{2d})Y$ wherein W has from 1 to 10 carbon atoms an is selected from alkylene and W'—Z—$(W'')_e$ *where W' and W'' are alkylene, Z is O, S, NHCO, NHSO₂*, and e is 0 or 1, Y is hydrogen, fluoro, or perfluoroalkoxy of 1 to 6 carbon atoms, and d is 2 to 20.

6. The composition of claim 1, wherein the treatment bath is at a pH range of 2.5 to 4.

7. The composition of claim 1, wherein an application of the composition is by a continuous process.

8. The composition of claim 1, wherein the composition is applied to a polyamide substrate.

9. The composition of claim 1, wherein a ratio of the amount of the condensate to fluorocarbon is limited by the substrate.

10. A one bath-one step total stain protection process comprising adding an effective amount of a sulfomethylated phenol-formaldehyde condensate and an effective amount of a nonionic aqueous fluorocarbon solution to a polyamide substrate.

11. The process of claim 10, wherein the sulfomethylated phenol-formaldehyde condensate is:

$$[R—CH_2]_n—CH_3SO_3M \quad [1]$$

Where R is a phenolic derivative such as naphthol, alkyl naphthol, thiodiphenol, alkylthiodephenol, phenol, alkylphenol, 4,4'-dihydroxydiphenyl sulfone, alkyl 4,4'-dihydroxydiphenyl sulfone, 4,2'-dihydroxy diphenyl sulfone, alkyl 4,2'dihydroxydiphenyl sulfone, bisphenol 'A 'or alkylbisphenol "A" and n=1 to 6;

and M is H, an alkali metal,—$NH_4$, or an amine (primary, secondary or tertiary).

12. The process of claim 10, wherein the nonionic fluorocarbon is a fluorinated ester.

13. The process of claim 10, wherein the nonionic fluorcarbon is a fluorinated ester of a multi-ring anhydride.

14. The process or claim 10 wherein the monionic fluorocarbon is:

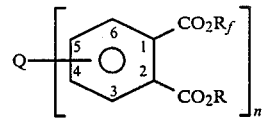

wherein n is 2 or 3 Q has a valence equal to n and is selected from the group consisting of a single carbon-carbon bond,—$C_mH_{2m}$—, $C_mH_{2m-1}$—, —CO—,—NH—,—O—,—S—,—$SO_2$—, wherein m is 1 to 6, R is selected from -$CH_2CH(R_1)OH$, —$CH_2$ $_{CH(OH)CH_2}X$, —$CH_2CH(R_1)OCH_2CH(R_1)OH$, or —$CH_2CH(OH)CH_2OCHCH(OH)CH_2X$ wherein $R_1$ is hydrogen or methyl and X is chloro, bromo, hydroxy, or cyano;

$R_f$ is a fluorinated radical of the formula —$W(c_dF_{2d})Y$ wherein W has from 1 to 10 carbon atoms is selected from alkylene and W'—Z—$(W'')_e$ where W' and W'' are alkylene, Z is O, S, NHCO, $NHSO_2$, and e is 0 or 1, Y is hydrogen, fluoro, or perfluoroalkoxy of 1 to 6 carbon atoms, and d is 2 to 20.

15. The process of claim 10, wherein the treatment bath is at a pH range of 2.5 to 4.

16. The process of claim 10, where in application of the composition is by a continuous process.

17. A polyamide textile fiber protected by the process of claim 10.

18. A polyamide carpet fiber protected by the process of claim 10.

* * * * *